US012484659B2

(12) United States Patent
Altrogge et al.

(10) Patent No.: US 12,484,659 B2
(45) Date of Patent: Dec. 2, 2025

(54) MIDSOLE WITH CUSHIONING STRUTS

(71) Applicant: ON CLOUDS GMBH, Zürich (CH)

(72) Inventors: Nils Arne Altrogge, Zürich (CH); Renaud Despots Allaire, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 0 days.

(21) Appl. No.: 18/704,316

(22) PCT Filed: Nov. 1, 2022

(86) PCT No.: PCT/EP2022/080398
§ 371 (c)(1),
(2) Date: Apr. 24, 2024

(87) PCT Pub. No.: WO2023/078843
PCT Pub. Date: May 11, 2023

(65) Prior Publication Data

US 2024/0415228 A1 Dec. 19, 2024

(30) Foreign Application Priority Data

Nov. 3, 2021 (CH) ..... 070488/2021

(51) Int. Cl.
*A43B 13/18* (2006.01)

(52) U.S. Cl.
CPC ..... *A43B 13/186* (2013.01); *A43B 13/18* (2013.01); *A43B 13/181* (2013.01)

(58) Field of Classification Search
CPC ..... A43B 13/181; A43B 13/18; A43B 13/185
USPC ..... 36/28
See application file for complete search history.

(56) References Cited

U.S. PATENT DOCUMENTS 5,461,800 A * 10/1995 Luthi ..... A43B 13/206 36/114
5,822,886 A 10/1998 Luthi et al.
D554,842 S * 11/2007 Gaenssler ..... A43B 21/26 D2/964

(Continued)

FOREIGN PATENT DOCUMENTS

WO WO 2016/184920 A1 11/2016

OTHER PUBLICATIONS

EPO (Rijswijk, NL), English version of the International Search Report, Form PCT/ISA/210, for corresponding International Application PCT/EP2022/080398, Jan. 24, 2023 (2 pp.).

*Primary Examiner* — Marie D Bays
(74) *Attorney, Agent, or Firm* — Pauley Erickson & Swanson

(57) ABSTRACT

A shoe, with a midsole including a forefoot area, a heel area and a midfoot area arranged between the forefoot area and the heel area. A midsole tip and a heel edge wherein a longitudinal direction of the midsole extends from the heel edge to the midsole tip. A top layer and a bottom layer with a vertical direction of the midsole extending from the bottom layer to the top layer. A cushioning structure is arranged between the top layer and the bottom layer and includes a plurality of elastically deformable struts each extending from a bottom connecting point with the bottom layer to a top connecting point with the top layer and each including a strut edge arranged in the longitudinal direction closer to the midsole tip than the bottom connecting point and the top connecting point.

21 Claims, 2 Drawing Sheets

(56) References Cited

U.S. PATENT DOCUMENTS

| | | | | |
|---|---|---|---|---|
| 2006/0201028 | A1* | 9/2006 | Chan | A43B 13/141 36/28 |
| 2009/0241371 | A1* | 10/2009 | Kimura | A43B 13/181 36/35 R |
| 2010/0126040 | A1* | 5/2010 | Grote | A43B 13/181 36/28 |
| 2010/0223810 | A1* | 9/2010 | Lekhtman | A43B 13/181 36/27 |
| 2011/0138652 | A1* | 6/2011 | Lucas | A43B 13/14 36/28 |
| 2015/0033581 | A1* | 2/2015 | Barnes | A43B 13/188 36/83 |
| 2016/0183632 | A1* | 6/2016 | Scofield | A43B 13/187 36/28 |
| 2016/0219974 | A1* | 8/2016 | Izquieta Anaut | B29D 35/122 |
| 2016/0374428 | A1 | 12/2016 | Kormann et al. | |
| 2020/0085139 | A1* | 3/2020 | Izquieta Anaut | A43B 13/181 |
| 2023/0082535 | A1* | 3/2023 | Vu | A43B 13/38 36/28 |

* cited by examiner

MIDSOLE WITH CUSHIONING STRUTS

CROSS REFERENCE TO RELATED APPLICATION

This application is a National Phase filing in the United States, under 35 USC § 371, of PCT International Patent Application PCT/EP2022/080398, filed on 1 Nov. 2022 which claims the priority of Swiss Patent Application No. CH 070488/2021, filed 3 Nov. 2021.

The above-referenced applications are hereby incorporated by reference herein in their entirety and are made a part hereof, including but not limited to those portions which specifically appear hereinafter.

BACKGROUND OF THE INVENTION

Field of the Invention

The present invention lies in the field of shoe technology, in particular cushioning of vertically and horizontally acting forces and relates to a midsole for a shoe, a shoe comprising such a midsole and the use of such a midsole in the manufacturing of a shoe.

Discussion of Related Art

A large number of running shoes with different cushioning systems is, known in the prior art, Sports and leisure shoes with soles having a gel core in the heel area to ensure vertical cushioning during tread, i.e. footfall, are commonly employed. Furthermore, improvements in vertical cushioning properties have been achieved, by placing individual spring elements in the heel area between the outsole and insole.

Furthermore, cushioning of vertically acting forces can also be achieved by providing channels within the soles. Upon exerting vertically acting forces, the soles are compressed, which entails a constriction of the channels providing for a cushioning effect.

While the above-mentioned soles improve the vertical cushioning properties of the shoes, they cannot achieve satisfactory cushioning of forces acting horizontally on the sole and shoe. Forces with a large horizontal component are additionally amplified, especially on inclined routes, and due to a lack of sufficient cushioning they represent one of the main causes of frequently occurring knee and hip joint pain.

A sole is known from WO 2016 184 920 of the applicant which has downwardly projecting, laterally open, segmented and channel-shaped elements. Under the effect of the forces occurring during running, the channel-shaped elements are deformable both vertically and horizontally until their lateral openings are closed.

A problem often observed with horizontal cushioning is that it is typically achieved by shearing the top layer of a sole (i.e. the layer being attached to the insole) with respect to the bottom layer of the sole (i.e. the layer being contacted with the ground, respectively being attached to an outsole). Such a shearing can provide the wearer with an unstable and thus uncomfortable feeling if no measures are taken to reduce instabilities.

Furthermore, many cushioning systems suffer from the disadvantage that the increased cushioning is accompanied by a force loss during push off, because cushioning systems are usually soft and thus a significant portion of the runner's push-off force is inefficiently absorbed by the cushioning system itself.

Another problem of cushioning soles is that the cushioning is often achieved by providing specific materials, e.g. polymer foams or gel cores, which typically increase the weight of the shoe, which in turn entails faster exhaustion of the wearer.

SUMMARY OF THE INVENTION

It is therefore the general object of the present invention to advance the state of the art of cushioning midsoles and preferably to overcome one or more disadvantages of the midsoles known in the prior art. In favorable embodiments, a midsole is provided which allows to efficiently absorb and thus cushion both vertically and horizontally acting forces. In particularly favorable embodiments, unstable treading and a thus associated unstable feeling is avoided or at least diminished. In further advantageous embodiments, a midsole is provided which allows both for efficiently cushioning vertically and horizontally acting forces, but also decreases or prevents the force loss during push-off. In further advantageous embodiments, a midsole is provided which allows for efficiently cushioning vertically and horizontally acting forces, but also has a low overall weight.

The general object is achieved by a midsole, a shoe and the use of a midsole according to the independent claims. Further advantageous embodiments follow from the dependent claims and the overall disclosure.

A first aspect of the invention concerns a midsole for a shoe, in particular a running shoe, comprising a forefoot area, a heel area and a midfoot area being arranged between the forefoot area and the heel area. The midsole further comprises a midsole tip and a heel edge. A longitudinal direction of the midsole extends from the heel edge to the midsole tip. Thus, it is understood that the heel edge lies in the heel area and represents the heel end portion of the midsole and the midsole tip in the forefoot area of the midsole and represents the front end portion of the midsole. The midsole further comprises a top layer and a bottom layer. The top layer and the bottom layer are typically opposing each other and separated from each other. A vertical direction of the midsole extends from the bottom layer to the top layer. It is understood that the vertical direction is perpendicular to the longitudinal direction. The midsole additionally comprises, a cushioning structure being arranged between the top layer and the bottom layer. The cushioning structure comprises, or optionally consists of, a plurality of elastically deformable struts. Each of the struts extends from a bottom connecting point with the bottom layer to a top connecting point with the top layer. Thus, each strut extends from the bottom layer to the top layer. Each strut further comprises a strut edge, which is arranged in the longitudinal direction closer to the midsole tip than the bottom connecting point and the top connecting point of the corresponding strut. Thus, each strut is typically inclined in an acute angle between >0° and <90 to the bottom layer and also in an acute angle between >0° and <90° to the top layer. In other words, each of these struts extends in the vertical direction from the bottom layer to the top layer such that each strut, starting from the bottom layer, extends in the longitudinal direction, i.e. in the direction of the midsole tip, and as understood also in the vertical direction, until it reaches the strut edge of this strut. From its strut edge, each strut extends then against the longitudinal direction, i.e. in the direction of the heel edge, and as understood also in the vertical direction, to the top layer.

The strut typically undergoes a direction change at the strut edge, which may thus be a strut tip pointing towards the midsole tip. The strut edge is configured as, respectively serves as, a predetermined folding edge, i.e. an edge at which folding will occur upon exerting a vertically acting force on the midsole, thereby providing a cushioning of the force exerted on the runner's foot. Furthermore, due to the arrangement of each strut, in particular due to the strut edges pointing all towards the midsole tip, forces acting horizontally on the runner's foot can be efficiently absorbed, because the struts generally are configured to enable a shearing of the top layer with respect to the bottom layer. Thus, while the bottom layer remains at its position on the ground, the top layer is sheared into the running direction due to the elastic deformation of the struts enabled by each of the struts and particularly by the strut edge orientation.

In certain embodiments, some or all of the struts extend in the vertical direction from the bottom layer to the top layer such that each strut extends linearly from the bottom layer along the longitudinal direction, i.e. in the direction of the midsole tip, up to a strut edge and extends linearly from the strut edge against the longitudinal direction, i.e. in the direction of the heel edge, to the top layer. In certain embodiments, each strut extends such from the bottom layer to the top layer that it only undergoes a single change of direction, i.e. at the corresponding strut edge.

In some embodiments, some or all of the struts have a cross section along the longitudinal direction and perpendicular to the transverse direction with a curved shape, i.e. the shape of a segment of a circle or of an ovoid.

The strut edge defines a change of direction of the corresponding strut extending from the bottom layer to the top layer. The strut edge may be a curve, i.e. be rounded or may be composed of two angled planes, i.e. be angular. In preferred embodiments, the strut edge is angular, as this allows for a controlled folding of the corresponding strut.

Directional indications as used in the present disclosure are to be understood as follows: The longitudinal direction LO of the midsole is described by an axis from the heel area, respectively from the heel edge, to the forefoot region, respectively to the midsole tip, and thus extends along the longitudinal axis of the midsole. Thus, the term "extending along/in the longitudinal direction" typically refers to extending towards the midsole tip and the term "extending against the longitudinal direction" typically refers to extending towards the heel edge. The transverse direction TR of the midsole extends transversely to the longitudinal axis and substantially parallel to the bottom layer of the midsole, or substantially parallel to the ground in the operative state. Thus, the transverse direction runs along a transverse axis of the midsole. In the context of the present invention, the vertical direction V denotes a direction from the bottom layer to the top layer of the midsole in the direction of the insole, or in the operative state in the direction of the foot of the wearer, and thus runs along a vertical axis of the midsole. Thus, the term "extending along/in the vertical direction" typically refers to extending towards the top layer of the midsole and the term "extending against the vertical direction" typically refers to extending towards the bottom layer of the midsole. The longitudinal direction, the vertical direction and the transverse direction may all be perpendicular to each other. The lateral side of the midsole is the outer perimeter of the midsole between the heel edge and the sole tip, which in the worn state rests against the outer instep of the wearer's foot. The medial side of the midsole, refers to the inner perimeter of the midsole between the heel edge and the sole tip, which is located opposite the lateral side. Thus, in a pair of worn running shoes, the medial sides of the two running shoes face each other and the lateral sides face away from each other. Furthermore, the midsole may typically along the longitudinal direction be divided into a forefoot area, a heel area and a midfoot area being arranged between the forefoot area and the heel area. For example, the forefoot area extends from the midsole tip against, i.e. opposite, the longitudinal direction to 30-45% of the total length of the midsole in the longitudinal direction. The heel area extends, for example, from the heel edge in the longitudinal direction to 20-30% of the total length of the midsole in the longitudinal direction. The midfoot area extends directly between the heel area and the forefoot area, such that the length in the longitudinal direction of the midfoot area makes up the remaining portion of the total length, particularly from 15-50% of the total length.

In the cross-section along the longitudinal direction and perpendicular to the transverse direction, or also in a view on the medial side or the lateral side of the midsole, the struts may in some embodiments each have a chevron shape.

The struts may typically each extend along the transverse direction of the midsole. For example, the struts may extend from the medial side of the midsole towards the lateral side of the midsole or vice versa. In specific embodiments, the struts may extend completely along the transverse direction of the midsole, i.e. extend completely from the medial side to the lateral side of the midsole. In other embodiments, medial side struts may extend along only a portion of the transverse extension of the midsole, for example along at most 20%, at most 30%, at most 40% or less than 50% of midsoles transverse extension towards the lateral side of the midsole. Vice versa, lateral side struts may extend along only a portion of the transverse extension of the midsole, for example along at most 20%, at most 30%, at most 40% or less than 50% of midsoles transverse extension towards the medial side of the midsole.

The top layer and the bottom layer may in some embodiments be parallel to each other. In particular, the top layer and the bottom layer may be parallel to each other in the cross section along the longitudinal direction and perpendicular to the transverse direction and/or in the cross section along the transverse direction and perpendicular to the longitudinal direction.

The top layer and/or the bottom layer may typically completely, and in particular continuously, extend along the longitudinal direction of the midsole, i.e. from the heel edge to the midsole tip. The top layer and/or the bottom layer may typically completely and in particular continuously extend along the transverse direction of the midsole, i.e. from the medial side to the lateral side of the midsole.

In some embodiments, the midsole is free of struts which extend from the bottom layer, respectively the bottom connecting point, directly against the longitudinal direction of the midsole, i.e. from the bottom layer, respectively the bottom connecting point, directly in the direction of the heel edge.

The struts are typically separated from each other. This means that the struts are not directly connected with each other. It is however understood that each strut is in general connected to the bottom layer and to the top layer. Typically, each strut is only connected to the top layer and to the bottom layer, i.e. it is not directly connected to any other component, such as another strut or the like.

In some embodiments, the struts are configured such that the strut and/or the strut edge contacts the bottom layer under the forces acting on the midsole during running, particularly landing or push-off, and/or upon a force acting against the vertical direction of the midsole onto the midsole of 3000 N or less, in particular of 2500 N or less, in particular of 2000 N or less, and preferably of 1000 N to 3000 N, in particular of 1500 N to 3000 N, in particular of 1500 N to 2500 N, in particular of 1500 N to 2000 N. It is understood that such a contact is a non-permanent contact, i.e. it is an additional contact to the permanent bottom connecting point.

In some embodiments, the midsole further comprises a second strut type. It is understood that the struts with the strut edge as disclosed above may then be considered a first strut type. The second strut type is different from the first strut type. In particular, the second strut type may consist of straight struts, i.e. struts which do not contain a strut edge. The struts of the second strut type extend from the bottom layer to the top layer both in the vertical direction and along the longitudinal direction, i.e. in the direction of the midsole tip. In other, words, the struts of the second type are straight struts linearly extending from the bottom layer to the top layer being inclined to the bottom layer in an acute angle of less than 90°. Preferably, the struts of the second type are arranged, particularly only arranged, in the forefoot area.

In typical embodiments, the majority of the struts is of the first strut type.

In some embodiments, the midsole comprises on the medial side in total 10 to 25 struts, in particular 10 to 20 struts, in particular 14 to 18 struts. In some embodiments, the midsole comprises on the lateral side in total 10 to 25 struts, in particular 10 to 20 struts, in particular 14 to 18 struts.

In some embodiments, the struts, in particular the struts of the first type, are arranged in the heel area, the midfoot area and the forefoot area.

Typically, the struts are spaced apart, i.e. are spatially separated, from each other. In particular, the struts are arranged along the longitudinal direction one after the other. Two adjacent struts may be spaced apart from each other at the bottom layer by a certain distance of the two adjacent struts.

In some embodiments, the struts are arranged along the longitudinal direction one after the other and spaced apart from each other such that a cavity is formed between two adjacent struts. Each cavity may typically be in direct fluid communication with the outside environment. In certain embodiments, each cavity may comprise an opening at the lateral side and/or at the medial side of the midsole. Therefore, air can be freely exchanged between the outside environment and the cavities. The cavities reduce the overall weight of the midsole and further facilitate the deformation of the struts upon exerting vertical and/or horizontal forces on the midsole.

In some embodiments, the cushioning structure consists of the plurality of elastically deformable struts, in particular of the first type and optionally of the second type as described herein, and the cavities.

In some embodiments, the cushioning structure extends from the heel area via the midfoot area to the forefoot area. Preferably, along the longitudinal direction, the cushioning structure extends completely, in particular continuously, from the heel edge to the midsole tip.

In some embodiments, the cushioning structure, and in particular the struts, is configured such that under the forces acting on the midsole during running, in particular during landing or push-off, in the horizontal direction shearing of the top layer with respect to the bottom layer is enabled by elastic deformation of the struts.

At least some, or the majority, or all of the cavities are in some embodiments delimited, respectively defined, by two struts, i.e. two adjacent struts, and the top layer and the bottom layer. In some embodiments, the top layer and/or the bottom layer form straight inner wall portions of the corresponding cavity. A straight inner wall portion is a wall portion which extends linearly between the two adjacent struts. Therefore, the cross section of such cavities along the longitudinal direction and perpendicular to the transverse direction may be composed of, respectively defined as the shape of, two parallelograms arranged along the vertical direction on top of each other. A straight inner wall defined by the bottom layer has the advantage that a much more pronounced frictional lock can be achieved between the strut, respectively the base strut portion, when it rests or contacts the bottom layer during running. Furthermore, a straight inner wall defined by both the top layer and the bottom layer, and also the parallelogram shape of the cavities, has the advantage that shearing of the top layer with respect to the bottom layer is improved, which allows to increase the cushioning effect of horizontally acting forces.

In some embodiments, the cavities each extend along the transverse, and as understood along the vertical direction.

In some embodiments, the total open area on the lateral side or on the medial side of the midsole being defined by the sum of the cross-sections of all cavity openings is larger than the total closed surface area of the midsole on the lateral side or the medial side of the midsole. In particular, the ratio of the total open area on the lateral side or on the medial side of the midsole to the total closed surface area of the midsole on the lateral side or the medial side is between 3:5 to 4:5, preferably from 13:20 to 3:4.

In some embodiments, the struts are configured such that the cavity height of the cavity is reducible by at least 30%, in particular by 30% to 50%, under the forces acting on the midsole during running, particularly landing or push-off, and/or upon a vertical force acting against the vertical direction of the midsole onto the midsole of 3000 N or less, in particular of 2500 N or less, in particular of 2000 N or less, and preferably of 1000 N to 3000 N, in particular of 1500 N to 3000 N, in particular of 1500 N to 2500 N, in particular of 1500 N to 2000 N. The forces acting on the midsole during running can be readily determined, as they are exerted by an 80 kg standard runner. Such a deformation allows to efficiently cushion the forces exerted on the runner's foot during running. The cavity height is the distance between the top layer and the bottom layer of the corresponding cavity.

In some embodiments, at least some or the majority or all of the cavities have in the cross-section along the longitudinal direction and perpendicular to the transverse direction a chevron shape.

In some embodiments, at least some or the majority or all of the cavities are each delimited only along the longitudinal direction by two adjacent struts and in the vertical direction by the bottom layer and the top layer.

In some embodiments, the volume of a cavity and/or the distance between two adjacent struts at the bottom layer (i.e. the cavity width) and/or the cavity height of a cavity in the heel area and a cavity in the midfoot area is larger than the volume of a cavity and/or the distance between two adjacent struts at the bottom layer (i.e. the cavity width) and/or the cavity height of a cavity in the forefoot area. In certain embodiments, the volume of a cavity and/or the distance between two adjacent struts at the bottom layer (i.e. the cavity width) and/or the cavity height of a cavity in the midfoot area is larger than the volume of a cavity and/or the distance between two adjacent struts at the bottom layer (i.e. the cavity width) and/or the cavity height of a cavity in the forefoot area.

In some embodiments, the cavity height of a cavity, or of each of the cavities decreases, i.e. narrows along the transverse direction, i.e. from the opening on the medial side to the lateral side, and/or against the transverse direction, i.e. from the opening on the lateral side to the medial side.

In some embodiments, the struts are configured such that upon exerting forces on the midsole against the vertical direction and optionally superimposed forces in and against the longitudinal direction of the midsole, the portion of each cavity being in the vertical direction arranged between a strut edge and the bottom layer is constricted further than the portion of the corresponding cavity being in the vertical direction arranged between the strut edge and the top layer. Thus, in such embodiments, the cushioning structure is divided into two horizontal cushioning layers, namely a top cushioning layer and a bottom cushioning layer. The bottom cushioning layer in such embodiments provides a larger cushioning effect than the top cushioning layer. The top cushioning layer serves as a support layer which provides for a stable tread and efficient push-off. Furthermore, as during normal running, the cavity portions of the top cushioning layer are less constricted than the cavity portions of the bottom cushioning layer, there is still residual cushioning potential for locally impacting forces, such as for example if the runner steps on a branch of wood or a rock.

In some embodiments, each strut comprises a base strut portion being defined as the part of the strut extending from the bottom layer, respectively the bottom connecting point, to the strut edge, wherein the length of the base strut portion of at least some of the struts, in particular of the majority of the struts or all of the struts, is equal or shorter than the distance at the bottom layer to the along the longitudinal direction adjacent strut. This has the advantage that the corresponding base strut portion can and/or the strut edge can be brought in contact with the bottom layer upon forces acting vertically and optionally horizontally on the midsole. In other words, the forces being exerted on the midsole during running lead to a bending of the strut at the strut edge and bring the base strut portion of the strut in contact with the bottom layer, such that the base strut portion rests on the bottom layer. This has the advantage that a frictional lock occurs, which on the one hand stabilizes the tread, i.e. further shearing of the top layer with respect to the bottom layer is prevented or reduced to the frictional lock and on the other hand, the resting base strut portion allows for an efficient push-off, since the base strut portion is resting on the bottom layer and thus the muscular force of the runner can efficiently be made available for push-off.

In some embodiments, the cushioning structure is configured such that some of the strut edges are brought in contact with the, in the longitudinal direction, next adjacent strut and also with the bottom layer under the forces acting on the midsole during running. In these embodiments or if the length of the base strut portion is equal to the distance at the bottom layer to the, along the longitudinal direction, adjacent strut, i.e. equal to the distance at the bottom layer to the adjacent front strut, the corresponding strut edge comes in contact with the adjacent front strut, i.e. with its base strut portion. Therefore, a form lock is provided when the base strut portion rests on the midsole bottom layer, which significantly increases the tread stability.

It is further possible that each strut comprises in addition to the base strut portion a top strut portion being defined as the part of the strut extending from the strut edge to the top layer, respectively the top connecting point, of the midsole.

In some embodiments, the base strut portions are an even planes extending linearly in the longitudinal direction and in the vertical direction. In some embodiments, the top strut portions are even planes extending linearly against the longitudinal direction and in the vertical direction. Even planes, which have a linear surface are preferred over rounded or curved strut portions, because they can undergo a more pronounced form locking engagement with the bottom layer and thus increase tread stability.

In some embodiments, the length of the strut base portion of the struts in the midfoot area and optionally in the forefoot and/or optionally in the heel area, is larger than the strut top portion of the corresponding strut.

In some embodiments, at least some, in particular the majority or all, of the strut edges of the struts are essentially arranged in a single horizontal plane being preferably parallel to the bottom layer at least in the heel area and/or the midfoot area. The horizontal plane may delimit the lower cavity portion from the upper cavity portion.

In some embodiments, the struts are configured such that the strut, in particular the base strut portion and/or the strut edge, contacts the bottom layer under the forces acting on the midsole during running, particularly during landing or push-off, and/or upon a vertical force acting against the vertical direction of the midsole onto the midsole of 3000 N or less, in particular of 2500 N or less, in particular of 2000 N or less, and preferably of 1000 N to 3000 N, in particular of 1500 N to 3000 N, in particular of 1500 N to 2500 N, in particular of 1500 N to 2000 N. Preferably, when the base strut portion and/or the strut edge contacts the bottom layer, the top portion of the cavity is not completely closed, i.e. not completely constricted.

In some embodiments, the base strut portions of at least some, in particular the majority or all, of the struts extend in parallel to each other.

In some embodiments, the top layer is convexly shaped towards the bottom layer. Optionally, the top layer further forms a concavity facing away from the bottom layer, i.e. in the operative state towards the foot of the runner. Such a concavity may for example form the foot bed for the shoe and increase the stability of the foot towards undesired transverse motions with respect to the midsole.

In some embodiments, the bottom layer is convexly shaped towards the top layer. Optionally, the bottom layer further forms a concavity facing away from the top layer, i.e. in the operative state towards the ground, i.e. the running surface. Thereby, a groove along the longitudinal direction of the sole may be formed, which increases the cushioning effect by increasing the flexibility of the midsole. Furthermore, the weight of the midsole is reduced.

In embodiments in which the top layer is convexly shaped towards the bottom layer and/or the bottom layer is convexly shaped towards the top layer, the height of a cavity between adjacent struts may be narrowed from the medial or lateral opening along the transverse direction, in particular to the center of the midsole. In the cross section along the transverse direction and perpendicular to the longitudinal direction of the midsole, the top layer and the bottom layer may each have a parabolic shape, in particular at which the vertexes of the two parabolas fall together or are in the vertical direction offset to each other.

The convex and/or concave shape of the bottom layer or the top layer may also be realized only in a portion of the midsole along the longitudinal direction, e.g. only in the heel area and optionally in the midfoot area.

In some embodiments, the strut edge of the struts is curved and preferably defines a curve radius of between 1 mm to 5 mm, in particular of 2 mm to 4 mm.

In some embodiments, the strut edge is angular and preferably defines an angle, i.e. a smallest angle between the corresponding base strut portion and the remaining portion, i.e. the strut top portion, which is defined as the portion of the strut extending between the strut edge and the top layer, wherein this angle is between 45° to 90°, in particular between 55° to 80°.

In some embodiments, at least some of the struts, in particular the majority of the struts or all of the struts, each comprise a varying thickness upon extending between the bottom layer to the top layer. For example, each of these struts may be thicker at the strut edge and narrow towards the bottom layer and/or the top layer of the midsole. For example, a strut narrowing towards the bottom layer is more flexible and thus the cushioning effect can be adjusted.

In some embodiments, the ratio between the distance of two adjacent struts at the bottom layer to the strut thickness of one or both of these two adjacent struts is greater than 1:1, in particular 2:1 to 10:1, in particular 3:1 to 7:1. Thus, the strut thickness is smaller than the width of the cavities. This has the advantage that the midsole has a relatively low weight and that the struts are flexible enough to provide the desired cushioning effect.

In some embodiments, the strut thickness is between 1.5 mm to 5.0 mm, in particular between 2.5 mm to 4.0 mm.

In some embodiments, a strut base acute angle between a strut, in particular a base strut portion, of the plurality of struts and the bottom layer is less than 90°, in particular less than 85°, in particular less than 80°, and preferably between 20° and 85°, in particular between 200 and 750.

Typically, the strut base acute angle is smaller than the angle defined by the strut edge, i.e. the strut edge acute angle.

In some embodiments, a strut base acute angle between a strut, in particular a base strut portion, of the plurality of struts and the bottom layer decreases over the struts from the heel region to the midfoot region and optionally to the forefoot region. This leads to an increased cushioning effect in the heel area, which typically constitutes the area of the sole which first contacts the ground upon tread. Preferably, the strut base acute angle continuously decreases over the struts from the heel region to the midfoot region and optionally to the forefoot region.

In some embodiments, the distance between the bottom layer and the top layer decreases from the heel region to the midfoot region and optionally to the forefoot region. Thus, the distance between the bottom layer and the top layer has its maximum in the heel area. This leads to an increased cushioning effect in the heel area, which typically constitutes the area of the sole which first contacts the ground upon tread.

In some embodiments, the forefoot region comprises straight struts, i.e. struts of the second type, extending from the bottom layer to the top layer along the longitudinal direction, i.e. in the direction of the midsole tip, or alternatively the forefoot region comprises struts having a strut edge which defines an angle which is larger than the angle defined by the strut edges of the struts in the midfoot or heel area. In particular, the angle defines by the strut edges of the struts in the forefoot are may be between 1200 and less than 180°, in particular between 130° and 170°. A larger angle makes the struts stiffer, which is beneficial in the forefoot region, because typically the forefoot region does not require a pronounced cushioning effect, but must rather be stable in order to allow an efficient push-off.

In some embodiments, the top layer, the bottom layer and the plurality of struts are integrally formed, in particular by injection molding or by additive manufacturing. Preferably, the midsole is therefore a single piece midsole.

The midsole is typically made of a polymer material. This material may for example be non-foamed.

Suitable materials for the midsole, in particular the bottom layer, the top layer and the struts, include ethylene-vinyl acetate copolymer, thermoplastic polyurethane, polyolefins, polyesters, polyamides, polyether block amide and mixtures thereof.

In some embodiments, the material for the midsole may comprise a tensile modulus of 30 MPa to 50 MPa, in particular 35 MPa to 45 MPa.

In some embodiments, the material for the midsole may have a Shore D hardness (15 s) of 20 to 35, preferably of 20 to 30, in particular of 25.

A second aspect of the invention concerns a shoe, particularly a running shoe, comprising a midsole according to any of the described herein.

A third aspect of the invention concerns the use of a midsole according to any of the described herein in the manufacturing of a shoe particularly a running shoe. The use may for example comprise to attach an outsole to the bottom layer of the midsole and/or to attach an insole and/or an upper to the midsole.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

Figure 1A:
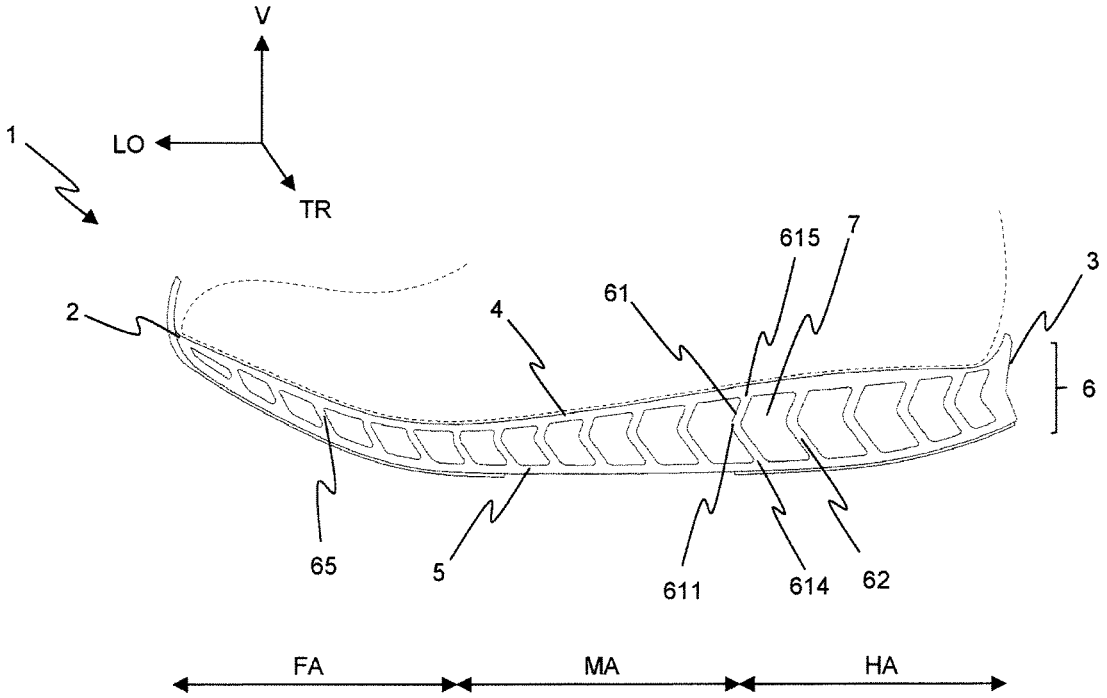
FIG. 1*a* shows a midsole according to an embodiment of the invention.

FIG. 1*a* depicts a midsole 1 for a shoe comprising forefoot area FA and heel area HA, between which midfoot are MA is arranged. Midsole 1 contains midsole tip 2 and a heel edge 3. As indicated by the spatial vectors, the longitudinal direction LO extends from the heel edge to the midsole tip. Additionally, midsole 1 comprises top layer 4 and bottom layer 5 which are spaced apart from one another by a cushioning structure 6. The cushioning structure 6 being arranged between top layer 4 and bottom layer 5 comprises a plurality of elastically deformable struts 61, 62 (only two of the struts are referenced for clarity purposes). Each of these struts 61, 62, extends from bottom connecting point 614 with the bottom layer 5 to top connecting point 615 (only the bottom/top connecting point 614, 615 of strut 61 are referenced for clarity reasons) with the top layer 4. It is understood that the top connecting point 615 represents the point at which the strut 61 is directly connected with the top layer 4, respectively the bottom connecting point 614 is the point at which strut 61 is directly connected with bottom layer 5. Each strut 61, 62 comprises further strut edge 611 (only a single strut edge of strut 61 is referenced for clarity purposes) being arranged in the longitudinal direction closer to the midsole tip 2 than the bottom connecting point 614 and the top connecting point 615.

Each of struts 61, 62 extends in vertical direction V starting from bottom layer 5 along the longitudinal direction LO, i.e. in direction of the midsole tip 2 and thus towards midsole tip 2, up to strut edge 611 (only a single strut edge of strut 61 is referenced for clarity purposes). From strut edge 611, strut 61 (and the other struts) extends against the longitudinal direction, i.e. in direction of the heel edge and thus towards the heel edge, up to top layer 4. Thus, strut edge 611 constitutes a directional change of strut 61 in the vertical-longitudinal plane. As can be seen, strut 61 is chevron shaped, wherein the tip, i.e. strut edge 611 points towards midsole tip 2. The struts are arranged along the longitudinal direction LO one after another and are spaced apart from each other. For example, strut 61 is along longitudinal direction LO arranged directly in front of strut 62, thereby forming and together with top layer 4 and bottom layer 5 delimiting, respectively defining, cavity 7. Struts 61 and struts 62 extend essentially in parallel to each other from the bottom layer to the top layer. Furthermore, the midsole comprises struts of a second type (chevron shaped struts 61 and 62 comprise a strut edge and are thus of the first type), such as strut 65 which is a straight strut extending from bottom layer 5 along the longitudinal direction (i.e. being inclined to the bottom layer towards midsole tip 2) to top layer 4.

Figure 1B:
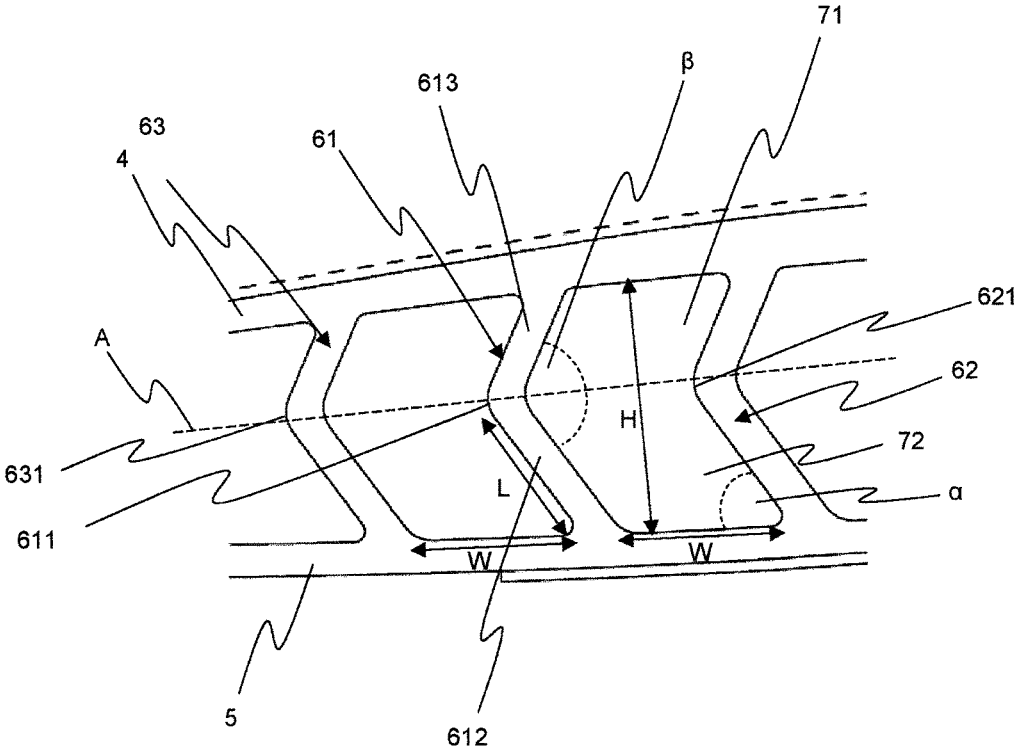
FIG. 1*b* shows an enlarged view of a portion of the shown in FIG. 1*a;*

FIG. 1*b* shows an enlarged view of midsole 1 depicted in FIG. 1 in the area of struts 61 and 62. Strut 61 comprises base strut portion 612, which is defined as that portion of strut 61, which extends from bottom layer 5 to strut edge 611. Vice versa, top strut portion 613 extends from strut edge 611 to top layer 4. Length L of base strut portion 612, i.e. the distance between the bottom layer 5 and strut edge 611 along the corresponding strut 61, is in this case equal to the cavity width W, i.e. the distance between strut 61 and adjacent strut 63 at bottom layer 5.

Cavity 7, being defined by struts 61 and 62 as well as top layer 4 and bottom layer 5 has a cavity height H, which is the distance between bottom layer 5 and top layer 4. Struts 61 to 63 comprise strut edges which lie in a single horizontal plane A. Struts 61 to 63 are configured such that upon exerting forces on the midsole against the vertical direction V of the midsole and optionally against the longitudinal direction LO of the midsole, the portion 72 of each cavity being in the vertical direction arranged between a strut edge and the bottom layer is constricted further than the portion 71 of the corresponding cavity being in the vertical direction arranged between the strut edge and the top layer. horizontal cushioning layers, namely a top cushioning layer 71 and a bottom cushioning layer 72.

Strut 62 forms a strut base acute angle $\alpha$ between its corresponding base strut portion and bottom layer 5 of between 20° and 85°. Strut edge 61 defines angle $\beta$ i.e. a smallest angle between the corresponding base strut portion 612 and the remaining portion, i.e. the strut top portion 613, which may be between 110° to 160°.

Figure 2:
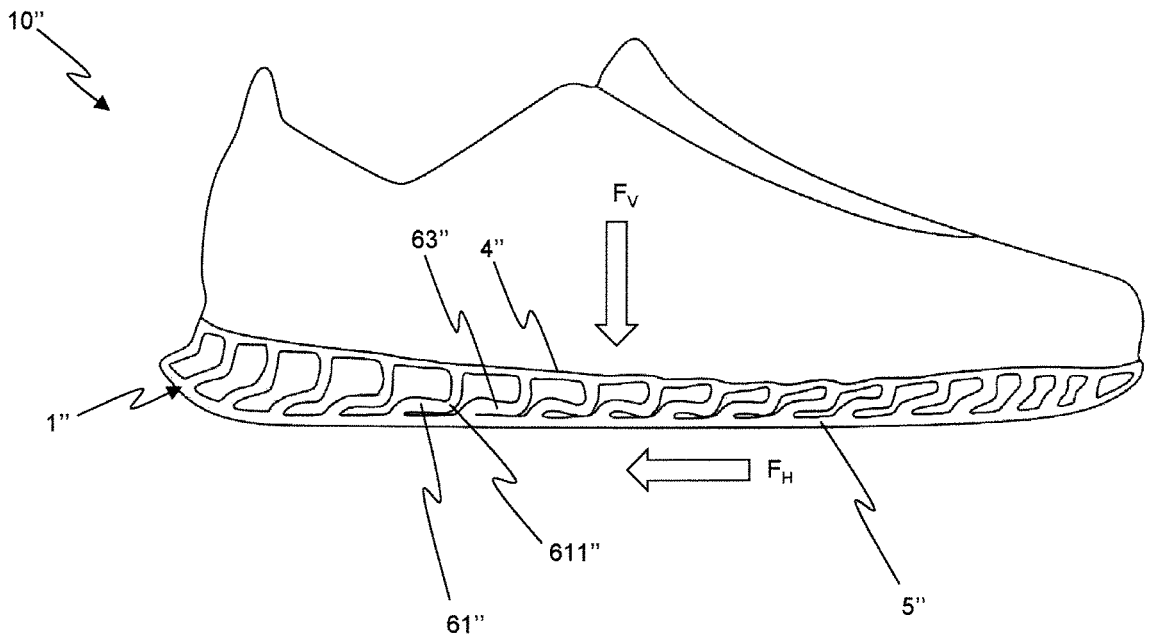
FIG. 2 shows a shoe with a midsole according to an embodiment of the invention being exposed to vertically and horizontally acting forces.

FIG. 2 shows shoe 10" comprising midsole 1" according to an embodiment of the invention. Shoe 10" is exposed to vertically acting forces FV which act against vertical direction V of midsole 1' and to horizontally acting forces FH, which act against the longitudinal direction of midsole 1'. Thus, FIG. 2 may illustrate a running scenario (runner's foot not shown for clarity purposes) after the initial contact with the ground has already occurred and the runner is currently in the rollover movement shortly before push-off, i.e. the majority of the runner's weight is currently centered on the midfoot area. Due to the acting forces, the struts are deformed, i.e. bent at their corresponding strut edges. As can be seen, the struts are configured such that the portion of each cavity being in the vertical direction arranged between a strut edge and the bottom layer is constricted further than the portion of the corresponding cavity being in the vertical direction arranged between the strut edge and the top layer. In the midfoot region, the portion below the corresponding strut edges and the bottom layer is almost completely constricted, i.e. the lower portion of some of the cavities is already completely collapsed, while the upper portion, i.e. the portion of the cavity between the strut edge and the top layer is less constricted. In the midfoot area and also partially in the heel area, base strut portion and/or strut edge (see 611") is brought in contact with bottom layer 5", respectively rests on bottom layer 5" which entails a frictional lock which decreases further shearing of the top layer against the bottom layer. Furthermore, as the width of the cavities is equal to the length of the corresponding base strut portion forming the wall of the cavity which is closest to the heel edge, the base strut portion 611" comes also in contact at the bottom layer 5" with the next adjacent strut 63" being arranged in front of strut 61", which enables a form-locking engagement and thus prevents any further shearing of top layer 4" against bottom layer 5". Therefore, not only are vertically and horizontally acting forces efficiently cushioned, but also a stable and secure tread and efficient push-off is enabled.

Figure 3:
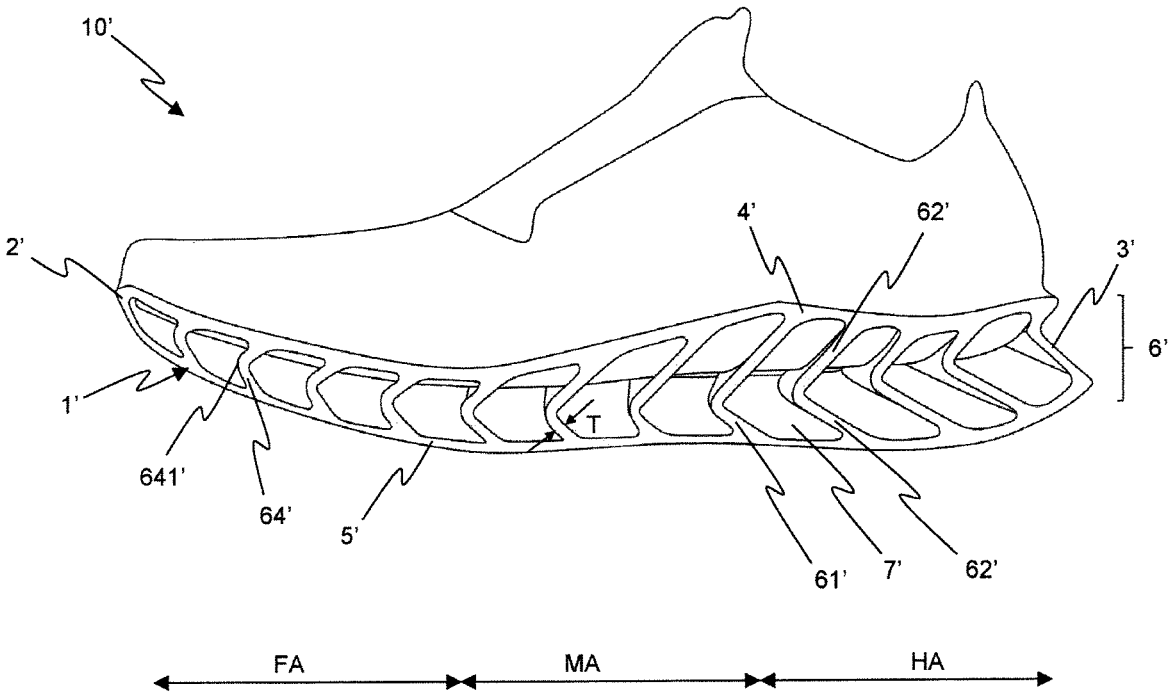
FIG. 3 a shoe with a midsole according to another embodiment of the invention.

FIG. 3 shows a shoe with a midsole 1' according to another embodiment of the invention with a view on the lateral side of the midsole. Midsole 1' comprises top layer 4', which is separated from bottom layer 5' by cushioning structure 6' containing a plurality of struts, such as struts 61' and 62'. As in the embodiments described above, the struts each extending in the vertical direction from the bottom layer to the top layer such that each strut extends from bottom layer 5' along the longitudinal direction towards midsole tip 2' up to a strut edge and then extends from the strut edge against the longitudinal direction towards heel edge 3' to top layer 2'. In the heel area HA and in midfoot area MA, top layer 4 is convexly shaped with respect to, i.e. towards, bottom layer 5'. Thus, cavity 7' formed and defined by struts 61' and 62', which is further defined by top layer 4' and bottom layer 5' is constricted from its opening on the lateral side towards the center of the midsole, respectively in the direction of the medial side, i.e. along the transverse direction of midsole 1'. This, means, the cavity height decreases against the transverse direction form the lateral sided cavity opening (the transverse direction extends from the medial side to the lateral side of midsole 1').

The measurements for the vertical force at which the strut and/or the strut edge contacts the bottom layer, respectively at which the cavity height of the cavity is reduced by at least 30% can be determined by the following test procedure: A runner with 80 kg of weight wears a shoe comprising a midsole to be tested. The runner runs of a 3D force plate (Model: Kistler Type 9260 AA; Sampling Frequency 1000 Hz), while the tread onto the force plate is recorded by a high speed camera (Model: Phantom High Speed Camera; Sampling Frequency 1000 Hz). As data processing software BioWare (Kistler) and Kinovea 0.9.4 has been used. By comparing the measured forces with the pictures of the high speed camera, the vertical force required at which the strut and/or the strut edge contacts the bottom layer, respectively at which the cavity height of the cavity is reduced by at least 30% can be readily determined. The percentage of height decrease can be determined by the ratio of (non-deformed cavity height—deformed cavity height)/non-deformed cavity height. The deformed cavity height can be directly obtained from the corresponding high speed camera picture.

The invention claimed is:

1. A midsole (1, 1', 1") for a shoe, the midsole (1, 1', 1") comprising:

a forefoot area (FA), a heel area (HA) and a midfoot area (MA) arranged between the forefoot area (FA) and the heel area (HA);

a midsole tip (2, 2') and a heel edge (3, 3') wherein a longitudinal direction (LO) of the midsole (1, 1', 1") extends from the heel edge (3, 3', 3") to the midsole tip (2, 2', 2");

a top layer (4, 4', 4") and a bottom layer (5, 5', 5"), wherein a vertical direction (V) of the midsole (2, 2', 2") extends from the bottom layer (5, 5', 5") to the top layer (4, 4', 4");

a cushioning structure (6, 6') arranged between the top layer (4, 4', 4") and the bottom layer (5, 5', 5");

wherein the cushioning structure (6, 6') comprises a plurality of elastically deformable struts (61, 62, 63, 61', 62', 64', 61", 63") each extending from a bottom connecting point (614) with the bottom layer (5) to a top connecting point (615) with the top layer (4) and each comprising a strut edge (611, 621, 631, 641', 611") arranged in the longitudinal direction closer to the midsole tip (2, 2') than the bottom connecting point (614) and the top connecting point (615), wherein the cushioning structure is configured such that some of the strut edges are brought into contact with a next adjacent strut in the longitudinal direction under the forces acting on the midsole during running.

2. The midsole (1, 1') according to claim 1, wherein the struts (61, 62, 63, 61', 62') are arranged in the longitudinal direction (LO) one after the other and spaced apart from each other such that a cavity (7, 7') is formed between two adjacent struts (61, 62, 61', 62').

3. The midsole (1, 1', 1") according to claim 2, wherein the struts (61, 62, 63, 61', 62', 64', 61", 63") are configured such that the cavity height (H) of the cavity (7, 7') is reducible by 30% to 50%, under the forces acting on the midsole (1) during landing or push-off and/or upon a vertical force acting against the vertical direction of the midsole (1) onto the midsole (1) of 3000 N or less.

4. The midsole (1) according to claim 2, wherein the struts are configured such that upon exerting forces on the midsole (1) against the vertical direction (V) and optionally superimposed forces in and against the longitudinal direction (LO), a portion (72) of each cavity (7) being in the vertical direction (V) arranged between a strut edge (611) and the bottom layer (5) is constricted further than a portion (71) of the corresponding cavity (7) in the vertical direction (V) arranged between the strut edge (611) and the top layer (4).

5. The midsole (1) according to claim 2, wherein each strut (61, 62, 63) comprises a base strut portion (612) defined as the part of the strut (61) extending from the bottom connecting point (614) with the bottom layer (5) to the strut edge (611), wherein a length (L) of the base strut portion (612) of at least some of the struts (61) is equal or shorter than a distance (W) at the bottom layer between the strut (61) and an—in the longitudinal direction—adjacent strut (62).

6. The midsole (1, 1', 1") according to claim 5, wherein the struts (61, 62, 63, 61', 62', 64', 61", 63") are configured such that the base strut portion (612) and/or the strut edge (611, 621, 631, 641'), contacts the bottom layer (5) under the forces acting on the midsole (1) during landing or push-off and/or upon a vertical force acting against the vertical direction (V) of the midsole (1) onto the midsole (1) of 3000 N or less.

7. The midsole (1, 1', 1") according to claim 5, wherein the base strut portions (612) of at least some of the struts (61, 62) extend in parallel to each other.

8. The midsole (1') according to claim 1, wherein the top layer (4') is convexly shaped towards the bottom layer (5') and/or wherein the bottom layer is convexly shaped towards the top layer.

9. The midsole (1, 1') according to claim 1, wherein the strut edge (611, 621, 631, 641') of the struts (61, 62, 63, 64') is curved and defines a curve radius of between 1 mm to 5 mm.

10. The midsole (1') according to claim 1, wherein a thickness of at least some of the individual struts (61', 62', 64') varies between the bottom layer (5') to the top layer (4').

11. The midsole (1, 1') according to claim 1, wherein the ratio between the distance (W) of two adjacent struts (61, 62, 63, 61', 62') at the bottom layer (5, 5') to the strut thickness (T) is greater than 1:1.

12. The midsole (1) according to claim 1, wherein a strut base acute angle ($\alpha$) between a strut (62) of the plurality of struts and the bottom layer (5) is between 20° and 85°.

13. The midsole (1) according to claim 1, wherein a strut base acute angle ($\alpha$) between a base strut portion, of the plurality of struts and the bottom layer (5) decreases in the longitudinal direction, from the heel region (HA) to the midfoot region (MA) or to the forefoot region (FA).

14. The midsole (1) according to claim 1, wherein at least some of the strut edges (611, 621, 631) of the struts (61, 62, 63) are arranged within a single horizontal plane (A) being essentially parallel to the bottom layer (5).

15. The midsole (1, 1') according to claim 1, wherein a distance (H) between the bottom layer (5) and the top layer (4) decreases from the heel region (HA) to the midfoot region (MA) or to the forefoot region (FA).

16. The midsole (1) according to claim 1, wherein the forefoot region comprises straight struts (65) extending from the bottom layer (5) to the top layer (4), wherein the straight struts (65) are inclined to the bottom layer (5).

17. The midsole (1, 1') according to claim 1, wherein the top layer (4), the bottom layer (5) and the plurality of struts (61, 62, 63, 64, 65, 61', 62', 64') are integrally formed by injection molding or by additive manufacturing.

18. A shoe (10, 10') comprising a midsole (1, 1') according to claim 1.

19. A use of a midsole (1) according to claim 1 in the manufacturing of a shoe.

20. The midsole according to claim 1, wherein the cushioning structure is configured such that some of the strut edges are brought in contact with bottom layer under the forces acting on the midsole during running.

21. A midsole (1, 1', 1") for a shoe, the midsole (1, 1', 1") comprising:

a forefoot area (FA), a heel area (HA) and a midfoot area (MA) being arranged between the forefoot area (FA) and the heel area (HA); a midsole tip (2, 2') and a heel edge (3, 3') wherein a longitudinal direction (LO) of the midsole (1, 1', 1") extends from the heel edge (3, 3', 3") to the midsole tip (2, 2', 2");

a top layer (4, 4', 4") and a bottom layer (5, 5', 5"), wherein a vertical direction (V) of the midsole (2, 2', 2") extends from the bottom layer (5, 5', 5") to the top layer (4, 4', 4"); and a cushioning structure (6, 6') arranged between the top layer (4, 4', 4") and the bottom layer (5, 5', 5"); wherein the cushioning structure (6, 6') comprises a plurality of elastically deformable struts (61, 62, 63, 61', 62', 64', 61", 63") each extending from a bottom connecting point (614) with the bottom layer (5) to a top connecting point (615) with the top layer (4) and each comprising a strut edge (611, 621, 631, 641', 611") being arranged in the longitudinal direction closer to the midsole tip (2, 2') than the bottom connecting point (614) and the top connecting point (615), wherein the cushioning structure is configured such that some of the strut edges are brought in contact with bottom layer under the forces acting on the midsole during running.

* * * * *